US006892462B2

(12) United States Patent
Rager

(10) Patent No.: US 6,892,462 B2
(45) Date of Patent: May 17, 2005

(54) VERTICAL IN-LINE BOW SIGHT

(75) Inventor: Christopher A. Rager, Three Forks, MT (US)

(73) Assignee: Trophy Ridge, LLC, Bozeman, MT (US)

( * ) Notice: Subject to any disclaimer, the term of this patent is extended or adjusted under 35 U.S.C. 154(b) by 0 days.

(21) Appl. No.: 10/196,333

(22) Filed: Jul. 16, 2002

(65) Prior Publication Data

US 2003/0046820 A1 Mar. 13, 2003

Related U.S. Application Data

(63) Continuation of application No. 09/607,243, filed on Jun. 30, 2000, now Pat. No. 6,418,633.

(51) Int. Cl.[7] ..... F41G 1/467
(52) U.S. Cl. ..... 33/265; 124/87; 42/136
(58) Field of Search ..... 33/265; 124/87; 42/136–139

(56) References Cited

U.S. PATENT DOCUMENTS

| | | | | |
|---|---|---|---|---|
| 3,521,362 A | | 7/1970 | Duplechin | 33/265 |
| 3,648,376 A | | 3/1972 | Millnarnow | 33/265 |
| 3,945,127 A | | 3/1976 | Spencer | 33/265 |
| 3,997,974 A | | 12/1976 | Larson | 33/265 |
| 4,159,575 A | | 7/1979 | Kalmbach | 33/265 |
| 4,162,579 A | | 7/1979 | James | 33/265 |
| 4,215,484 A | | 8/1980 | Lauffenburger | 33/265 |
| 4,291,664 A | | 9/1981 | Nishioka | 124/87 |
| 4,418,479 A | | 12/1983 | Stachnik | 33/265 |
| 4,541,179 A | | 9/1985 | Closson | 33/365 |
| 4,884,347 A | | 12/1989 | Larson | 33/265 |
| 4,928,394 A | | 5/1990 | Sherman | 33/265 |
| 5,174,269 A | | 12/1992 | Sappington | 124/87 |
| 5,231,765 A | | 8/1993 | Sherman | 42/132 |
| 5,285,767 A | | 2/1994 | Padilla | 124/87 |
| 5,517,979 A | | 5/1996 | Closson | 124/86 |
| 5,560,113 A | | 10/1996 | Simo et al. | 33/265 |
| 5,579,752 A | | 12/1996 | Nelson et al. | 124/87 |
| 5,619,801 A | | 4/1997 | Slates | 42/132 |
| 5,632,091 A | | 5/1997 | Brion et al. | 33/265 |
| 5,634,278 A | * | 6/1997 | London | 33/265 |
| 5,638,604 A | * | 6/1997 | Lorocco | 33/241 |
| 5,644,849 A | | 7/1997 | Slates | 33/265 |
| 5,653,217 A | | 8/1997 | Keller | 124/87 |
| 5,676,122 A | * | 10/1997 | Wiseby et al. | 128/87 |
| 5,685,081 A | * | 11/1997 | Winegar | 33/265 |
| 5,718,215 A | | 2/1998 | Kenny et al. | 124/87 |

(Continued)

FOREIGN PATENT DOCUMENTS

WO WO 97/32175 A2 9/1997

OTHER PUBLICATIONS

"Trophy Ridge, Chris Rager: True Innovator" article from "Inside Archery" magazine, Mar. 2003, pp. 43–53.*
"TNN Outdoors" magazine, Trophy Ridge product ad., Oct. 2001, p. 90.*
"Bow Hunting World" magazine, Trophy Ridge product ad., Aug. 2001, p. 14.*

(Continued)

*Primary Examiner*—Randy W. Gibson
(74) *Attorney, Agent, or Firm*—Merchant & Gould, P.C.

(57) ABSTRACT

A bow sight having a support structure, and two or more vertically aligned vertical pins connected to the support structure is provided. At least two of the vertical pins include a sight point. In accordance with another aspect of the invention, a bow sight having a support structure connected to two or more sight points is provided. The two or more sight points are rotationally adjustable such that they can be rotated into vertical alignment. In accordance with another aspect of the invention, a bow sight having a support structure, a sight point connected to the support structure, and a dampener is provided.

61 Claims, 11 Drawing Sheets

U.S. PATENT DOCUMENTS

| | | | | | |
|---|---|---|---|---|---|
| 5,836,294 | A | | 11/1998 | Merritt | 124/87 |
| 5,862,603 | A | | 1/1999 | Ellig | 33/265 |
| 5,956,854 | A | * | 9/1999 | Lorocco | 33/241 |
| 6,000,141 | A | | 12/1999 | Afshari | 33/265 |
| 6,016,608 | A | | 1/2000 | Lorocco | 33/265 |
| 6,061,919 | A | | 5/2000 | Reichert | 33/265 |
| 6,119,672 | A | | 9/2000 | Closson | 124/87 |
| 6,122,833 | A | | 9/2000 | Lorocco | 42/132 |
| 6,145,208 | A | | 11/2000 | Savage | 33/265 |
| 6,154,971 | A | | 12/2000 | Perkins | 33/265 |
| 6,216,352 | B1 | | 4/2001 | Lorocco | 42/145 |
| 6,276,068 | B1 | * | 8/2001 | Sheliga | 33/265 |
| 6,360,472 | B1 | | 3/2002 | Lorocco | 42/132 |
| 6,382,201 | B1 | | 5/2002 | McPherson et al. | 124/89 |
| 6,397,483 | B1 | | 6/2002 | Perkins | 33/265 |
| 6,418,633 | B1 | | 7/2002 | Rager | 33/265 |
| 6,421,946 | B1 | | 7/2002 | LoRocco | 42/111 |
| 6,443,142 | B1 | * | 9/2002 | Wiseby et al. | 124/87 |
| 6,477,778 | B1 | * | 11/2002 | Lorocco | 33/265 |
| 6,494,604 | B2 | * | 12/2002 | Khoshnood | 33/265 |
| 6,508,005 | B2 | * | 1/2003 | Springer | 33/265 |
| 6,560,884 | B1 | * | 5/2003 | Afshari | 33/265 |
| 6,601,308 | B2 | * | 8/2003 | Khoshnood | 33/265 |

OTHER PUBLICATIONS

"The Report: Products That Make Hunting That Much More Enjoyable" article by Bob Robb, from "Bow Masters" magazine, Oct. 2002, One page.*

"Bow Business: Trophy Ridge" article from "Bow Hunting" magazine, Nov. 2002, pp. 20 &22.*

"Bow Sights 2002" article from "Archery Business" magazine, Mar. 2002, pp. 54–59.*

Letter from Daniel E. Schmidt, Managing Editor. of "Deer & Deer Hunting" magazine, Jan. 30, 2001, One page.*

Letter from Bob Mizek, Director of Operations, New Archery Products, Feb. 23, 2001, One page.*

Letter from Mark Melotik, Editor, "Archery Business" magazine, Mar. 20, 2002, One page.*

"1996 Product Catalog", Scout Mountain Equipment, 1996 (5 pages).

"2000 Catalog" and instructions for using Savage pendulum feather weight, Savage Systems, Inc., (13 pages), 2000.

"Cobra Scopes", http://web.archive.org/web/19980519141812/www.cobraarchery.com/html/cobra_scopes.html, Cobra Manufacturing, 1997 (2 pages).

"Cobra Signature Scope", http://web.archive.org/web/19980519141855/www.cobraarchery.com/html/cobra_signature_scop ..., Cobra Manufacturing, 1997 (2 pages).

"Declaration of James Postweiler" relating to Altier Archery sight including Exhibits A–F (8 pages), Jun., 2003.

"Declaration of Ronald H. Carson" relating to Altier Archery sight including Exhibits A–F (8 pages), Jun., 2003.

"Optimizer–Lite–Eclipse (Model OL–EC)", instruction manual for HHA Sports (2 pages).

"Sights", http://www.sight–master.com/p22.html, Sight Master, ©1999 (6 pages).

Majestic Hunter bow sight from Altier Archery. (One page description with 8 photographs), Sep. 2003.

Bow sight from HHA Sports. (One page description with 6 photographs), Sep. 2003.

Bow sight from Tru–Glo, Inc., including Affidavit of David Stroh with 2 photographs, May 1997.

* cited by examiner

VERTICAL IN-LINE BOW SIGHT

This is a continuation of application Ser. No. 09/607,243 filed Jun. 30, 2000, now U.S. Pat. No. 6,418,633.

FIELD OF THE INVENTION

The invention relates to a sight for a bow. In particular, the bow sight includes vertical sight points. The invention also relates to vertical sight points that are rotationally adjustable for the achievement of vertical alignment despite the amount of bow torque applied by the archer to the bow. The invention also relates to a bow sight including a dampener.

BACKGROUND OF THE INVENTION

This invention relates generally to the field of archery equipment and more particularly to a novel sighting apparatus for use with an archery bow.

Bow sights generally have multiple sight points for use in shooting arrows into targets of different distances from the archer. Many bow sights include multiple sight points attached to horizontal pins. Bow sights with horizontal pins are shown in U.S. Pat. Nos. 5,103,568; 5,676,122; and 5,685,081.

A number of U.S. patents disclose bow sights having various other arrangements of sighting points. See, for example, U.S. Pat. Nos. 3,234,651; 4,120,096; 5,086,567; and 5,131,153.

SUMMARY OF THE INVENTION

A bow sight having a support structure, and two or more vertically aligned vertical pins connected to the support structure is provided. At least two of the vertical pins include a sight point.

In accordance with another aspect of the invention, a bow sight having a support structure connected to two or more sight points is provided. The two or more sight points are rotationally adjustable such that they can be rotated into vertical alignment.

In accordance with another aspect of the invention, a bow sight having a support structure, a sight point connected to the support structure, and a dampener is provided.

BRIEF DESCRIPTION OF THE DRAWINGS

FIGS. 10*a–d* are a rear view, front view, left view and right view respectively of a vertical pin according to the principles of the present invention.

DETAILED DESCRIPTION OF THE PREFERRED EMBODIMENT

In the following description of the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
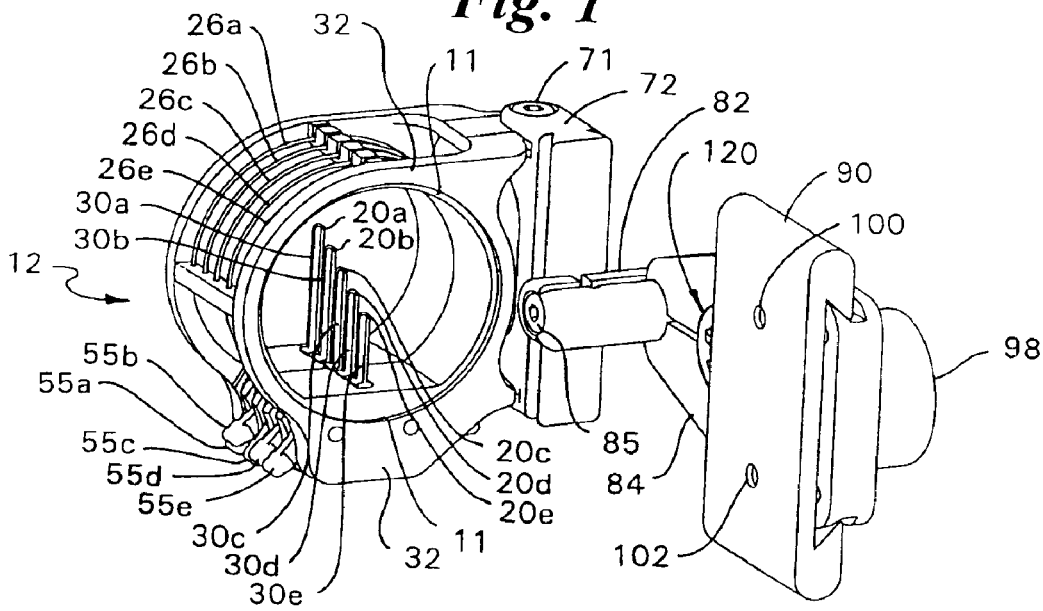
FIG. 1 is a perspective view of a bow sight according to the principles of the present invention.
Figure 2:
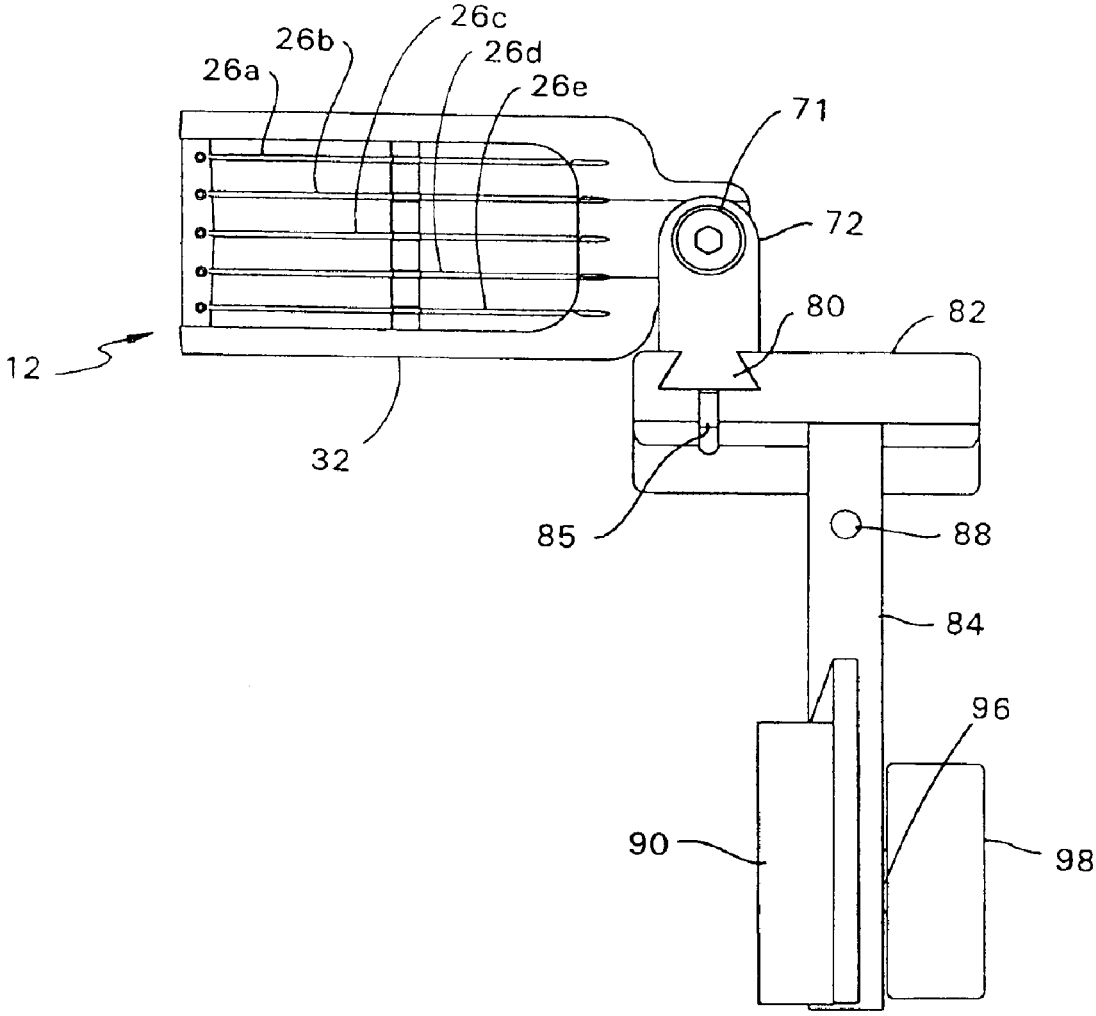
FIG. 2 is a top view of a bow sight according to the principles of the present invention.

A bow sight is a device that is attached to an archery bow and which provides one or more sight points. The archer uses the sight point(s) to aim at the target. A peep sight may be placed on the string of the bow such that the archer can sight through the peep sight and at the sight point with the target in the background. FIG. 1 shows a preferred embodiment of a bow sight 12. For purposes of this application, the view of the bow sight as seen from the archer in the shooting position is referred to as the front view of the bow sight.

A sighting point is any shape, point, or indicia of any sort that is visually placed in line with the target to be shot at for assisting in the proper aiming of the bow. Sight points can be circular shapes, other geometrical shapes, colored dots, the end of a light gathering cable, or simply the end of a sight pin, for example.

In a preferred embodiment, the sight points 20*a–e* are formed by the ends of the fiber optic cables 26*a–e*. The fiber optic cables 26*a–e* collect light along their lengths and the light exits the end of the cables 26*a–e*. In this preferred embodiment, the ends of the fiber optic cables 26*a–e* are held in place by vertical pins.

A vertical pin is a member having a vertically elongated portion, wherein that member supports a sight point and wherein the sight point may be integral with or a separate piece from the vertical pin. A vertical pin could include features in addition to the fact that it has a length that is vertical. For example, a vertical pin could be an L-shaped pin with the horizontal portion of the L-shape extending in the direction toward the archer in the shooting position. See FIG. 8 for an example of an L-shaped pin that falls within the definition of a vertical pin.

Vertical pins have a significant advantage over horizontal pins because the field of view to the right and left of the vertical pins is very open for viewing the target and the environment of the target area.

In a preferred embodiment, the vertical pins 30*a–e* are linear vertical pins that define a hole in the uppermost end for receiving the ends of the fiber optic cables 26*a–e*.

In another preferred embodiment, the vertical pins are linear vertical pins that do not define a hole in the uppermost end. In this embodiment, the ends of the fiber optic cables 26*a–e* are glued or crimped to the ends of the vertical pins 30*a–e*.

A support structure is any structural member that supports a sight point. In a preferred embodiment, the support structure 32 is a generally circular shaped piece of acrylic that supports the vertical pins 30*a–e* which support the sight points 20*a–e* respectively. The circular shape of the support structure 32 provides protection of the vertical pins 30*a–e* from being damaged or bent while also providing a good view of the ultimate target through the interior portion of the circular support structure.

Figure 3A:
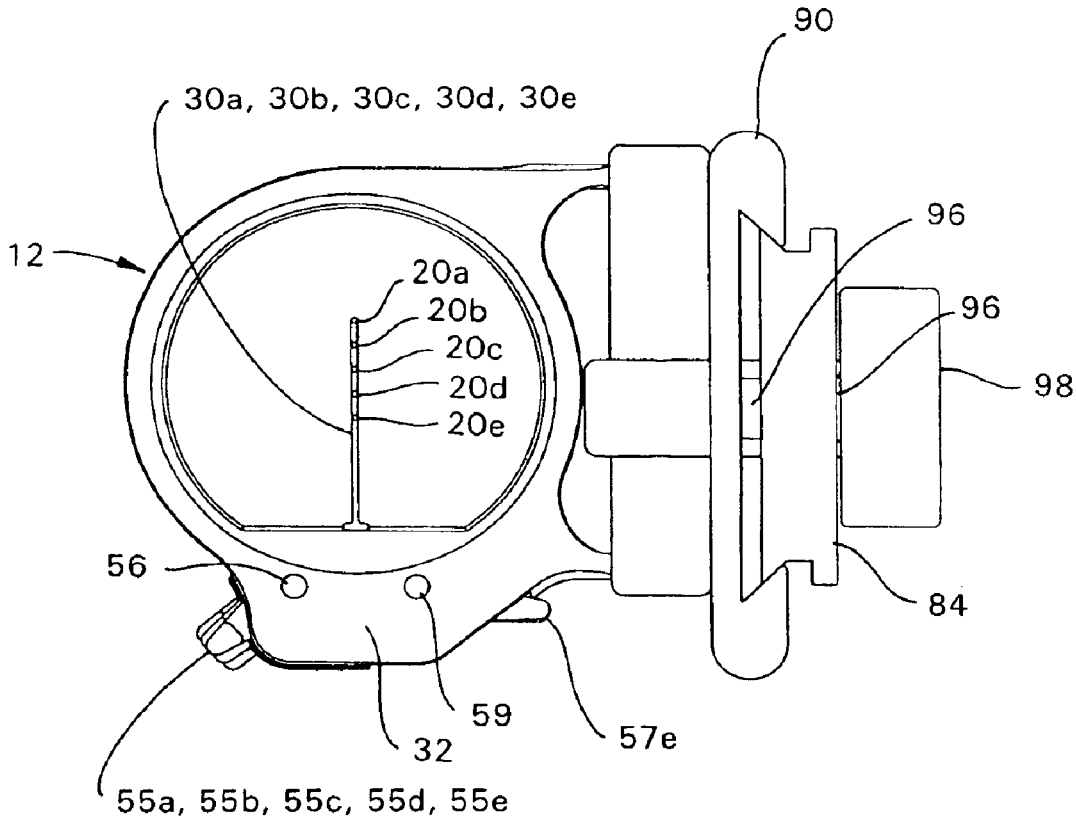
FIG. 3*a* is a front view of a first embodiment of a bow sight according to the principles of the present invention.
Figure 3B:
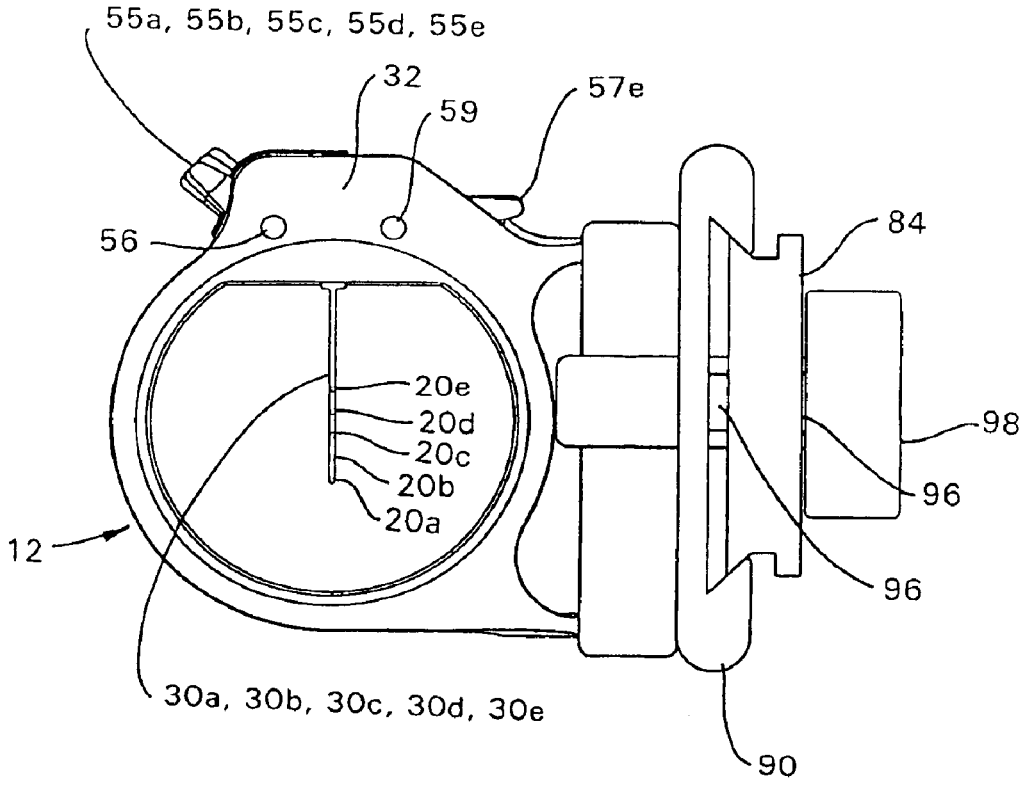
FIG. 3*b* is a front view of a second embodiment of a bow sight according to the principles of the present invention.
Figure 3C:
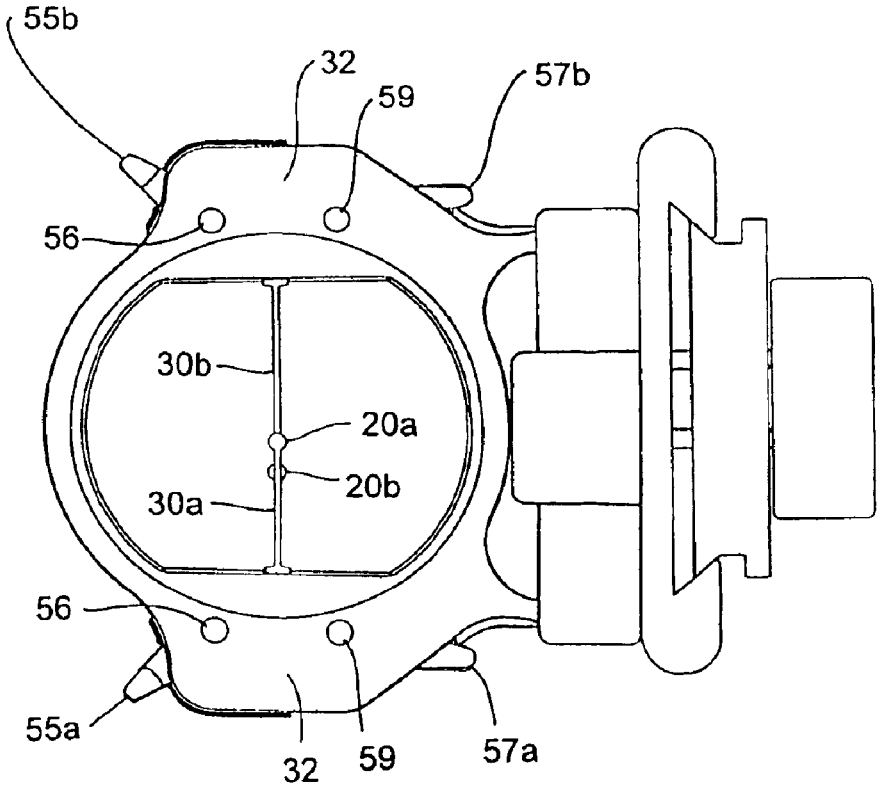
FIG. 3*c* is a front view of a third embodiment of a bow sight according to the principles of the present invention.

The point at which a vertical pin is attached to a support structure is the attachment point. Vertical pins can be attached to the support structure in many different orientations. Vertical pins can be attached to the support structure with the sight point below the attachment point (see, for example, FiG. 3*b*) or with the sight point above the attachment point (see, for example. FIG. 3*a*). It is also within the scope of the present invention to have a bow sight with one or more vertical pins attached to the support structure with the sight point below the attachment point and one or more vertical pins attached to the support structure with the sight point above the attachment point (see, for example. FIG. 3*c*).

It is often desired to adjust the sight point height associated with a particular vertical pin. These adjustments are made to "sight-in" the bow so that each sight point is accurately associated with a target of a particular distance. A vertical pin is "vertically adjustable" when the associated sight point for that vertical pin can be moved vertically up or down.

Figure 9:
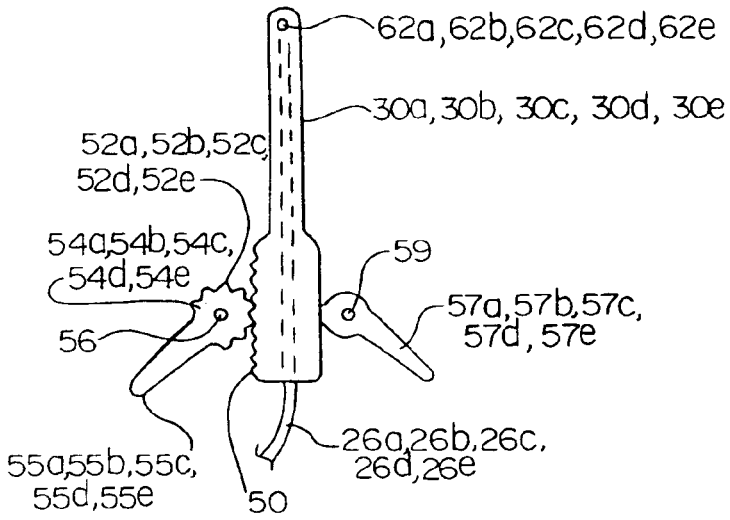
FIG. 9 is an exploded view of a vertical pin, an associated adjustment knob and an associated cam member according to the principles of the present invention.
Figure 9:
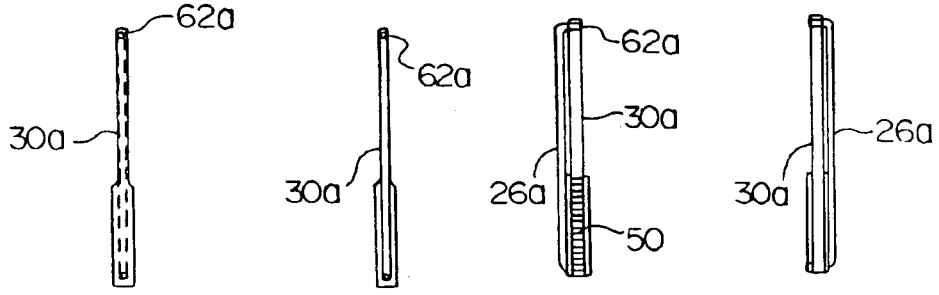

In a preferred embodiment, each of the vertical pins 30*a–e* is vertically adjustable by movement of the entire vertical pin. Each of the vertical pins 30*a–e* include gears, such as gears 50 on vertical pin 30*a* as shown in FIG. 9. Likewise, the adjustment knobs 54*a–e* each include gears, such as gears 52 on adjustment knob 54*a* as shown in FIG. 9. The gears on vertical pins 30*a–e* interact respectively with the gears on the adjustment knobs 54*a–e* such that rotation of an adjustment knob results in linear vertical motion of the respective vertical pin. The adjustment knobs 54*a–e* also include levers 55*a–e* respectively. The levers 55*a–e* are each integral with the corresponding adjustment knobs 54*a–e*. The lever makes it easier to rotate the adjustment knob.

Figure 6:
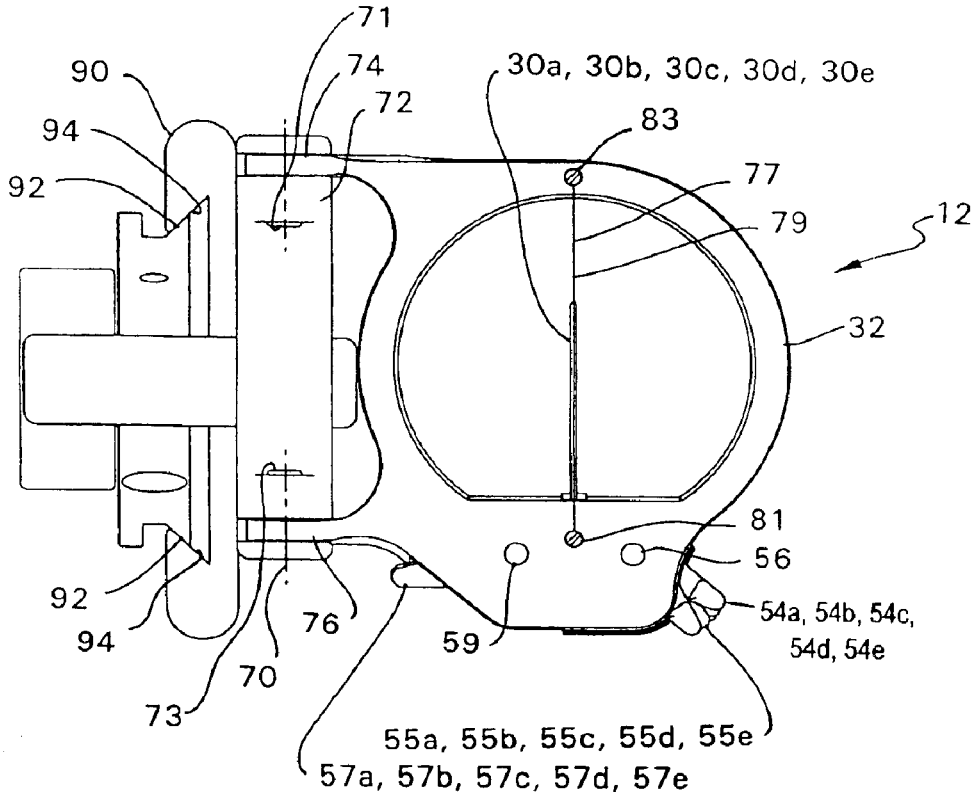
FIG. 6 is a back view of a bow sight according to the principles of the present invention and including a bow torque indicator.

As shown in FIG. 6, axis rod 56 extends through the center axis of the adjustment knobs 54*a–e*. The adjustment knobs 54*a–e* rotate around the axis rod 56.

The cam members 57*a–c* allow the archer to lock the vertical position of each vertical pin 30*a–e* respectively. The cam members 57*a–c* each comprise a cam portion 61*a–e* that rotates about an axis rod 59. Rotation of a cain member 57*a–e* results in engagement or disengagement of the respective cam portion 61*a–e* with the side of the vertical pin opposite the gears 50. This camming action allows the archer to prevent the vertical pins from moving once their vertical height is properly set.

In order to adjust the vertical position of a pin, the archer rotates the corresponding cam member, makes an adjustment of the vertical height of the pin by rotating the adjustment lever, and then rotates the cam member back into engagement with the vertical pin to hold the new vertical position. Once the pins are adjusted to the proper vertical position, it is of great importance that they not be accidentally moved. The cam members 57*a–e* accomplish this purpose by preventing rotation of the adjustment knobs 54*a–e* respectively.

Other means for preventing rotation of the adjustment knobs are contemplated. For example, a screw could be used in place of cam members 57*a–e*. Such screws (not shown) would extend perpendicular to the vertical pins and would extend through a hole in the support structure 32. Tightening of the screw associated with the vertical pin 30*a*, for example, would secure the vertical position of the sight point on vertical pin 30*a*. To adjust the height of vertical pin 30*a*, the associated screw is loosened and the adjustment knob 55*a* rotated.

In a preferred embodiment of the invention, the end of a light gathering cable is used as the sight point. A light gathering cable is any cable that collects light along the perimeter of its length and projects the light out the end of the cable. As discussed above, in a preferred embodiment, the light gathering cable is a fiber optic cable.

Figure 7:
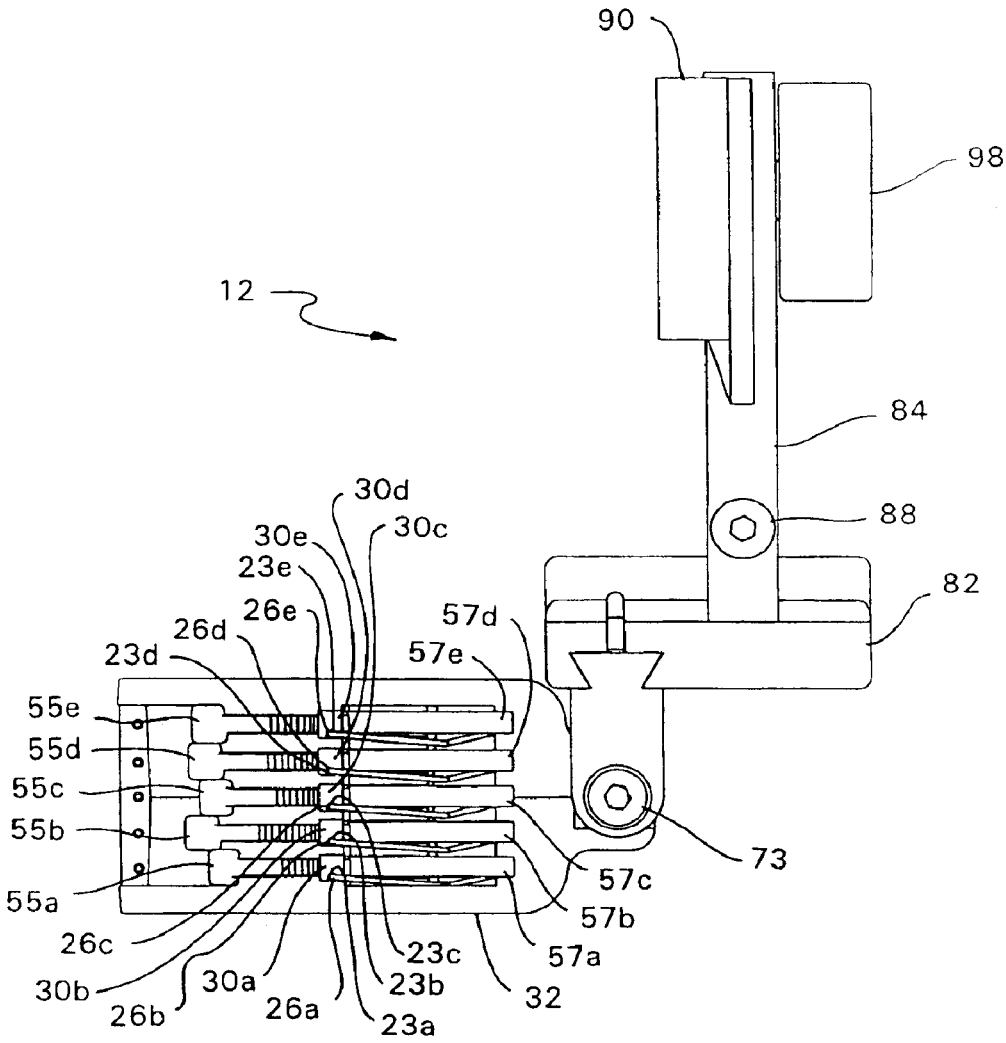
FIG. 7 is a bottom view of a bow sight according to the principles of the present invention.

Fiber optic cables 26*a–e* are mounted around the perimeter of the support structure 32 as shown in FIGS. 1, 2, 4, 5 and 7. As shown in FIG. 7, the fiber optic cables 26*a–e* extend within grooves 23*a–e* in the vertical pins 30*a–e*. The fiber optic cables are bent 45–90 degrees such that the end of the light gathering cables then pass through the holes 62*a–e* in the end of the vertical pins 30*a–e* respectively. The ends of the fiber optic cables 26*a–e* are the sight points in a preferred embodiment.

Each archer tends to hold a bow differently from the next. Some archers tend to torque the bow one way or another in the horizontal plane while shooting an arrow. Such bow torque brings the vertical pins 30*a–e* out of alignment and causes inaccurate shooting.

It is important that vertical alignment of the vertical pins be accomplished so that accuracy in shooting the bow with the bow sight can be achieved. Two vertical pins are "vertically aligned" when they are in a single vertical line as viewed from the position of the archer while holding the bow in the shooting position (with the string drawn). Vertical pins that do not form a single line as viewed from the archer, but that through an adjustment can be brought into a single line from the view of the archer still fall within the definition of "vertically aligned".

In a preferred embodiment, all five vertical pins 26*a–e* are vertically aligned. While the vertical pins 26*a–e* may not initially form a single line as viewed from the archer in the shooting position, the bow sight can be adjusted to bring the five pins 26*a–e* into a single line as viewed from the archer in the shooting position as will be described below.

In a preferred embodiment shown most clearly in FIG. 6, the bow torque adjustment feature is embodied in the ability to rotate the support structure 32 about a vertical axis 70. This bow torque adjustment feature allows for adjustment of bow torque to ensure vertical alignment of the vertical pins 30*a–e*. By rotating the support structure 32 around the vertical axis 70, an archer can set the bow sight 12 such that when that archer shoots the bow the vertical pins 30*a–e* all appear in a single line as viewed from the archer when shooting the bow.

In a preferred embodiment as shown in FIG. 6, the support structure 32 includes an upper sleeved arm 74 and a lower sleeved arm 76. Sleeve member 72 is rotationally connected to the support structure 32 along axis 70 by torque adjustment screw 71 and a torque adjustment screw 73 which both extend linearly along the vertical axis 70. An archer can loosen both torque adjustment screws 71 and 73 with an allen wrench (or by other means depending on the type of screw used) and then make the rotational adjustment between the sleeve member 72 and the support structure 32 as is necessary to bring the vertical pins 30*a–e* into vertical alignment in the shooting position. Once the correct rotational position is achieved, the torque adjustment screws 71 and 73 are tightened to prevent the sleeve member 72 and support structure 32 from rotating relative to one another.

FIG. 6 is a rear view of a bow sight according to the principles of the present invention. FIG. 6 includes a bow torque indicator 77 (not shown on the other drawings). A bow torque indicator is any vertical member that indicates to the archer whether there is bow torque. In a preferred embodiment as shown in FIG. 6, the bow torque indicator is a vertical wire 79 situated behind the vertical pins 30*a–e*. In a preferred embodiment, the vertical wire 79 is aircraft cable with a diameter of 0.030 inches. The vertical wire 79 is attached to the support structure by screws 81 and 83.

If bow torque is being applied to the bow, the archer will see that the vertical pins 30*a–e* are not lined up in a single vertical line with the bow torque indicating wire 79. The archer will then know that bow torque adjustment is required.

The attachment of the sleeve member 72 and support structure 32 to the bow is now described. The sleeve member 72 includes a double dove tail portion 80 that is received by a double dove tail recess in horizontal bar 82. A screw 85 allows for tightening and loosening of the sliding interaction between the double dove tail 80 and the double dove tail recess in the horizontal bar 82. The vertical position of the sleeve member 72 can therefore be adjusted relative to the horizontal bar 82. The horizontal bar 82 is received by an extender member 84 that has one end with an adjustable jaw 86 for holding and supporting the horizontal bar 82. The jaw 86 is adjustable via the screw 88. Thus, the horizontal bar 82 can be positionally adjusted horizontally from left to right as viewed from the archer in the shooting position.

The extender member 84 is releasably and adjustably connected to base 90. As shown in FIG. 6, extender 84 has a double dove tail 92 that is received by the double dove tail recess 94 of the base 90. Therefore, extender 84 is slidably received by the base 90 such that the base 90 and the extender 84 can be horizontally moved relative to one another toward and away from the archer.

As shown in FIG. 3, once the desired position of the extender 84 relative to the base 90 is determined, the extender 84 is nonslidably secured to the base 90 by screw 96 having adjustment knob 98. By tightening the adjustment knob 98, the screw 96 extends into a small recess (not shown) in the base 90 to prevent sliding movement between the extender 84 and the base 90.

Figure 5:
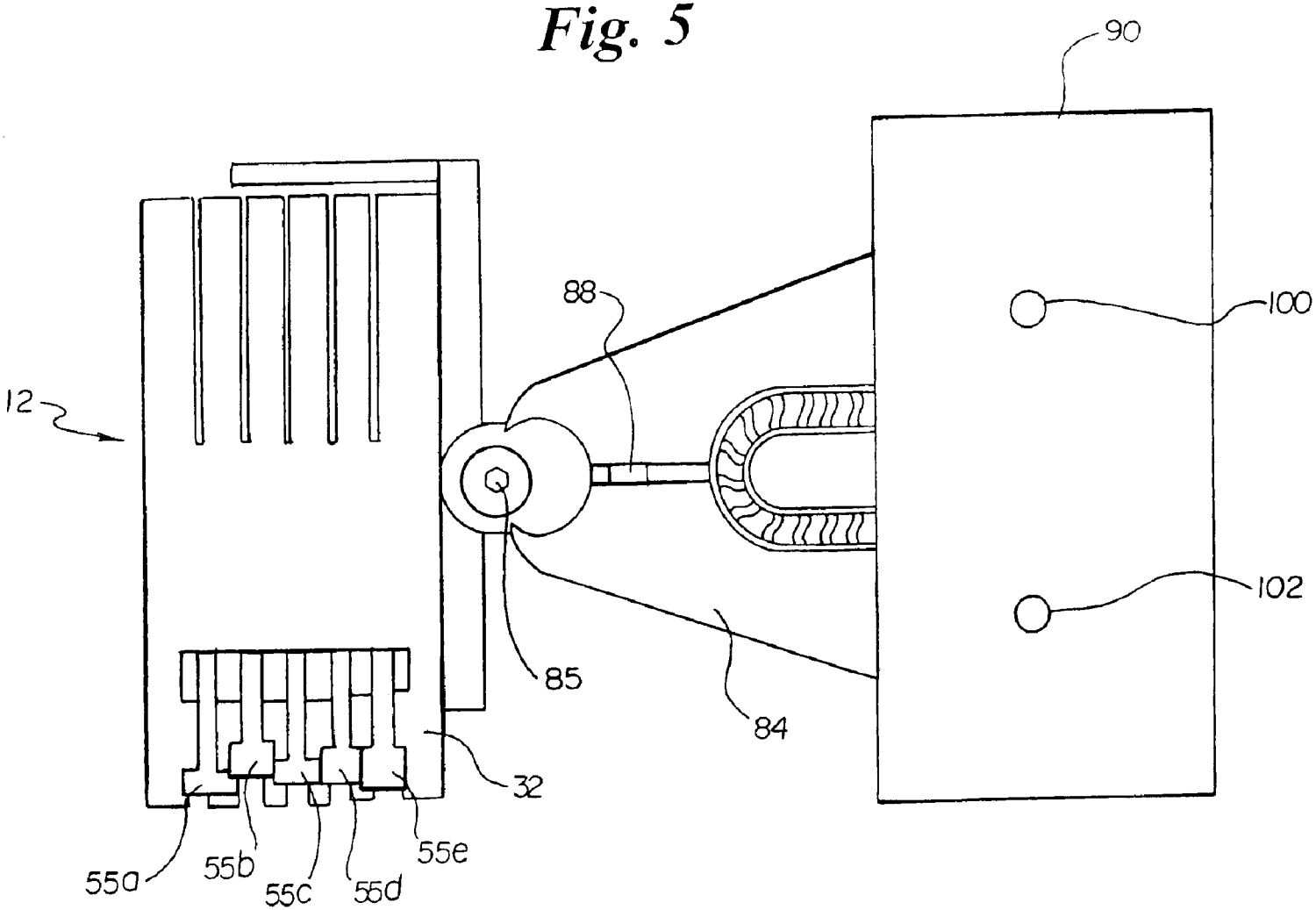
FIG. 5 is a left side view of a bow sight according to the principles of the present invention.

The base 90 is secured to the bow with two screws that pass through holes 100 and 102 and into the bow (see FIG. 5).

When the string on a bow is released, it creates significant vibrations. It is desired to reduce the vibrations for enhanced performance of the bow. In a preferred embodiment, dampeners are provided on the bow site. A dampener is any device which includes at least some material that is softer than the material that makes up the part of the bow sight to which the device is directly attached, such that the device at least partially absorbs the vibrations caused by the release of the bow string when shooting an arrow. Dampeners may be placed in the support structure itself or in any of the various members that connect the support structure to the bow.

Figure 4:
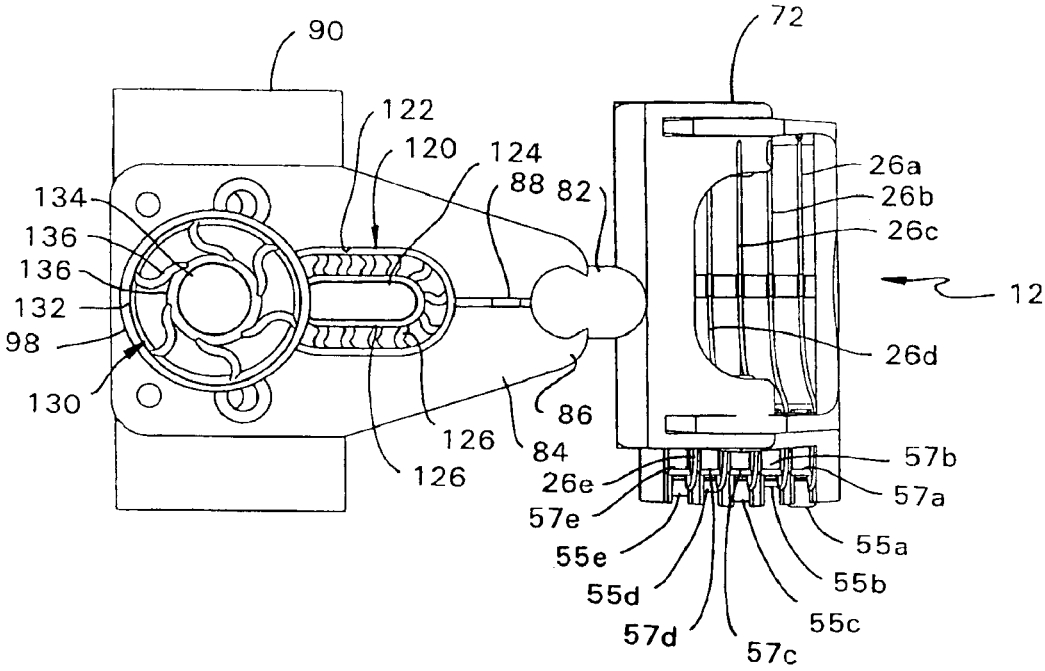
FIG. 4 is a right side view of a bow sight according to the principles of the present invention.

In a preferred embodiment shown in FIG. 4, a dampener 120 is secured in a recess 122 in the extender 84. The recess 122 and the dampener 120 are oval in shape but could be any shape. The dampener 120 comprises a brass core 124 surrounded by a webbed rubber member 126 around the perimeter of the brass core 124. Alternate materials can certainly be used for the dampener. For example, the core could be aluminum with an outer perimeter material of plastic.

In a preferred embodiment also shown in FIG. 4, dampener 130 is secured in a recess 132 in the adjustment knob 98. The dampener 130 and recess 132 in this embodiment are circular in shape but again could be any shape. The dampener 130 includes a brass core 134 and a webbed rubber member 136 around the perimeter of the brass core 134.

While particular locations of the dampeners 120 and 130 connected to the support structure 32 have been provided in the drawings, it is noted that dampeners may be connected to the support structure 32 in many different locations. For example, a dampener could be set in a recess (not shown) in the support structure 32.

Figure 8:
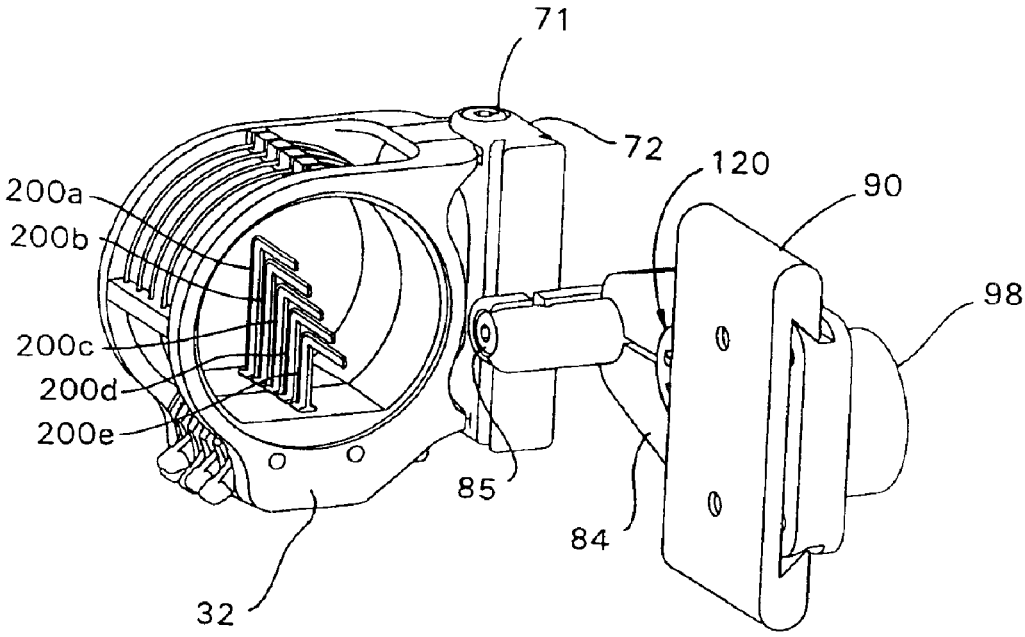
FIG. 8 is a perspective view of an alternate embodiment of a bow sight according to the principles of the present invention.

FIG. 8 is a perspective view of an alternative embodiment of the present invention. The difference between FIG. 1 and FIG. 8 is that the vertical pins 200*a–e* in FIG. 8 are L-shaped. That is, the vertical pins 200*a–e* have a vertical portion and also a horizontal portion. The horizontal portion extends in the direction towards the archer when the archer is standing in the shooting position.

In a preferred embodiment as shown in FIG. 8, the sight points 202*a–e* associated respectively with the vertical pins 200*a–e* are all in the same vertical plane.

FIGS. 10*a–d* show a preferred embodiment of a vertical pin 30*a* from the rear, front, left and right views respectively. The fiber optic cable 26*a* can also be seen in its relationship to the vertical pin 30*a*.

It is also noted that in an alternative preferred embodiment, the vertical pins 30*a–e* are protected by a circular and planar piece of non-opaque plexiglass. The plexiglass (not shown) fits within the rim 11 of the support structure 32 (see FIG. 1). A similar piece of plexiglass may be placed on the back side of the support structure 32.

In a preferred embodiment of the bow sight of the invention, the vertical pins, pin height adjustment levers, cam lock mechanisms and the support structure are made of acrylic plastic. It should be appreciated, however, that this invention is not limited by the type of material used for its parts. Many alternative materials can be used. For example, in an alternative embodiment these parts could be made of aluminum or any other material that can structurally perform the functions of these parts.

In a preferred embodiment, the sleeve member 72, horizontal bar 82, extender 84, base 90, and adjustment knob 98 are made of aluminum.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

I claim:

1. A bow sight comprising:

(a) a sight structure defining a viewing opening through which a target can be viewed;

(b) a first pin, a second pin and a third pin, each of the first, second and third pins comprising:

(i) a base end;

(ii) a free end supporting a fiber optic sight point; and (iii) a vertical portion between the base end and the free end;

(c) the first, second and third pins being vertically adjustable relative to each other;

wherein the first, second and third pins are vertically aligned and each of the sight points is visible when the archer peers through the viewing opening while holding the bow in a shooting position.

2. The bow sight according to claim 1, wherein all of the base ends are positioned below their corresponding free ends.

3. The bow sight according to claim 1, wherein only some of the base ends are positioned below their corresponding free ends.

4. The bow sight according to claim 1 wherein the viewing opening is defined by a viewing channel that extends from an open front end to an open back end of the sight structure, wherein the first, second and third pins are mounted within the viewing channel, and wherein the sight structure provides a substantially full enclosure about the pins that extends from the open front end to the open back end of the channel.

5. The bow sight according to claim 1 wherein the first, second and third pins have different lengths.

6. The bow sight according to claim 1, wherein the viewing opening is circular.

7. The bow sight according to claim 4, further comprising transparent end covers for enclosing the front and back ends of the viewing channel.

8. A bow sight for attachment to a bow, the bow sight comprising:

a first pin, a second pin, positioned behind the first pin, and a third pin positioned behind the second pin, each of the first, second and third pins comprising:

(i) a base end;

(ii) a free end supporting a fiber optic sight point; and (iii) a vertical portion between the base end and the free end;

(b) the first, second and third pins being vertically adjustable relative to one another;

wherein the first pin, the second pin, and the third pin are vertically aligned and each of the first, second and third sight points are visible by the archer when the archer holds the bow in a shooting position.

9. The bow sight according to claim 8, wherein the sight point of each of the first pin, second pin and the third pin is above the base end of the first pin, second pin, and third pin, respectively.

10. The bow sight according to claim 8 further comprising:

(a) a rotatable first adjustment member that causes the sight point of the first pin to move vertically relative to the sight points of the second and third pins when the first adjustment member is rotated;

(b) a rotatable second adjustment member that causes the sight point of the second pin to move vertically relative to the sight points of the first and third pins when the second adjustment member is rotated; and (c) a rotatable third adjustment member that causes the sight point of the third pin to move vertically relative to the sight points of the first and second pins when the third adjustment member is rotated.

11. The bow sight according to claim 10 further comprising:

(a) a first locking member that is rotated to cause the sight point of the first pin to be locked at a vertical position set by the first adjustment member;

(b) a second locking member that is rotated to cause the sight point of the second pin to be locked at a vertical position set by the second adjustment member; and (c) a third locking member that is rotated to cause the sight point of the third pin to be locked at a vertical position set by the third adjustment member.

12. The bow sight according to claim 10, wherein the first, second and third adjustment members each include a gear.

13. The bow sight according to claim 3, wherein the first adjustment member directly engages the first pin, the second adjustment member directly engages the second pin and the third adjustment member directly engages the third pin.

14. The bow sight according to claim 8, wherein the bow sight comprises aluminum.

15. The bow sight according to claim 8 further comprising a fourth vertical pin and a fifth vertical pin.

16. The bow sight according to claim 8 wherein the third pin is longer than the second pin, and the second pin is longer than the first pin.

17. A bow sight comprising:

(a) a support structure configured for attachment to a bow;

(b) a first pin and a second pin connected to the support structure, each of the first and second pins having:

(i) a first end positioned relative to the support structure at an attachment point;

(ii) a second end defining a sight point;

(iii) a vertical portion between the first end and the second end;

(iv) a locking member movable from a first position to a second position, wherein when in the first position, the member is engaged with a portion of the pin to lock the vertical position of the pin, and when in the second position, the member is disengaged with the portion of the pin; and (v) an adjustment member for moving the vertical position of the pin;

wherein the first pin and the second pin are vertically aligned when viewed by the archer holding the bow in a shooting position.

18. The bow sight according to claim 17, wherein the adjustment member has gears to interact with gears on the pin.

19. A bow assembly comprising:

(a) a bow having a frame and a string;

(b) a sight secured to the bow, the sight including:

a first pin, a second pin positioned behind the first pin and a third pin positioned behind the second pin;

fiber optic members including end portions secured to the first, second and third pins, the end portions defining sight points at the first, second and third pins;

the first, second and third pins being vertically movable relative to each other to set the sight points at different vertical positions relative to one another;

wherein the first, second and third pins are vertically aligned when viewed by the archer holding the bow in a shooting position.

20. A method of aiming at a target with a bow, the method comprising:

(a) providing a sight comprising:

a first pin and a second pin positioned behind the first pin;

a first fiber optic member that defines a first sight point supported by the first pin;

a second fiber optic member that defines a second sight point supported by the second pin;

(b) viewing the target through the sight by:

(i) vertically aligning each of the first and second pins;

(ii) viewing the first and second sight points while the first and second pins are vertically aligned; and (iii) aiming at the target by sighting on only one of the first and second sight points while the first and second pins are vertically aligned.

21. The method according to claim 20, wherein the step of viewing the target further includes peering through a peep sight.

22. The method according to claim 20, further comprising sighting-in the bow by vertically adjusting the first and second pins to position the first and second sight points to each correspond to a different target distance.

23. The method according to claim 22, wherein the target and the pins are viewed through a generally circular sight opening.

24. A method of aiming at a target with a bow, the method comprising:

providing a sight comprising: a first pin supporting a first sight point defined by a first fiber optic member, and a second pin supporting a second sight point defined by a second fiber optic member, the second pin being located behind the first pin;

sighting-in the bow by vertically adjusting the first pin relative to the second pin such that the first and second sight points each correspond to a different target distance; and aiming at the target by vertically aligning the first and second pins and then sighting on the sight point that corresponds most closely to the distance between the target and the archer.

25. A bow sight comprising:

(a) a first fiber optic sight point supported on a first member having a vertical portion as viewed by the archer from the shooting position, the first member supported by a structure mounted to a bow;

(b) a second fiber optic sight point supported on a second member having a vertical portion as viewed by the archer from the shooting position, the second member supported by the structure; and (c) a third fiber optic sight point supported on a third member having a vertical portion as viewed by the archer from the shooting position, the third member supported by the structure, wherein the vertical portions of the first member, the second member and the third member are vertically aligned when viewed by the archer holding the bow in a shooting position.

26. The bow sight according to claim 25, further comprising a fourth fiber optic sight point supported on a fourth member having a vertical portion, the fourth member supported by the structure mounted to a bow.

27. The bow sight according to claim 25, wherein the first, second and third fiber optic sight points are an end of a first, second and third fiber optic cable, respectively, each which extends along the first, second and third members, respectively.

28. The bow sight according to claim 1, wherein the first, second and third pins are metal.

29. The bow sight according to claim 8, wherein the first, second and third pins are metal.

30. The bow sight according to claim 19, wherein the first, second and third pins are metal.

31. The bow sight according to claim 25, wherein the first, second and third members are metal.

32. The bow sight according to claim 25, wherein the first, second and third members are aluminum.

33. A bow sight comprising:

a first pin, a second pin positioned behind the first pin, and a third pin positioned behind the second pin, the first, second and third pins being aligned along a vertical plane;

a first fiber optic member including an end defining a first sight point supported by the first pin;

a second fiber optic member including an end defining a second sight point supported by the second pin;

a third fiber optic member including an end defining a third sight point supported by the third pin; and the first, second and third pins being vertically movable relative to one another along the vertical plane;

wherein the first, second and third sight points can each be adjusted to a different vertical position along the vertical plane by vertically moving the first, second and third pins relative to one another.

34. The bow sight of claim 33, wherein the first, second and third fiber optic members each include first portions and second portions separated by a bend, the first portions of the first, second and third fiber optic members extending along lengths of their corresponding first, second and third pins, and the second portions of the first, second and third fiber optic members being supported by their corresponding first, second and third pins.

35. The bow sight of claim 33, wherein the first, second and third pins include metal.

36. The bow sight of claim 33, wherein the ends of the fiber optic members extend through openings defined by the pins.

37. The bow sight of claim 33, wherein the ends of the fiber optic members are secured to the pins.

38. The bow sight of claim 33, wherein the third pin is longer than the second pin and the second pin is longer than the first pin.

39. A bow sight comprising:

a first pin and a second pin positioned behind the first pin, the first and second pins being aligned along a vertical plane;

first and second fiber optic members respectively secured to the first and second pins, the first fiber optic member defining a first sight point at the first pin and the second fiber optic member defining a second sight point at the second pin;

a first adjustment member that is moved to generate vertical movement of the first pin relative to the second pin;

a second adjustment member that is moved to generate vertical movement of the second pin relative to the first pin;

wherein the first and second sight points can be adjusted to different vertical positions along the vertical plane by moving the first and second adjustment members.

40. The bow sight of claim 39, wherein the first adjustment member is rotated to generate non-rotational vertical movement of the first pin relative to the second pin, and the second adjustment member is rotated to generate non-rotational vertical movement of the second pin relative to the first pin.

41. The bow sight of claim 39, further comprising a first locking member for locking the first sight point at a desired vertical position set by the first adjustment member, and a second locking member for locking the second sight point at a desired vertical position set by the second adjustment member.

42. The bow sight of claim 39, wherein the first and second adjustment members each include gears.

43. The bow sight of claim 39, wherein the first and second adjustment members directly engage the first and second pins, respectively.

44. The bow sight of claim 39, wherein the first pin is shorter than the second pin.

45. The bow sight of claim 39, wherein the first and second pins are metal.

46. The bow sight of claim 41, wherein the first and second locking members include cams.

47. The bow sight of claim 39, wherein the pins can be adjusted without the use of a separate tool.

48. The bow sight of claim 41, wherein the pins can be adjusted and locked without the use of a separate tool.

49. A bow sight comprising:

a first pin, a second pin positioned behind the first pin, and a third pin positioned behind the second pin;

a first fiber optic sight point provided at the first pin, a second fiber optic sight point provided at the second pin, and a third fiber optic sight point provided at the third pin;

a first adjustment member that is rotated to generate vertical movement of the first pin relative to the second and third pins;

a second adjustment member that is rotated to generate vertical movement of the second pin relative to the first and third pins;

a third adjustment member that is rotated to generate vertical movement of the third pin relative to the first pin and second pins;

wherein the first, second and third sight points can be adjusted to different vertical positions by rotating the first, second and third adjustment members, and wherein the first, second and third pins are vertically aligned when viewed by the archer while holding the bow in a shooting position.

50. The bow sight of claim 49, further comprising a first locking member for locking the first sight point at a desired vertical position set by the first adjustment member, a second locking member for locking the second sight point at a desired vertical position set by the second adjustment member, and a third locking member for locking the third sight point at a desired vertical position set by the third adjustment member.

51. The bow sight of claim 49, wherein the first, second and third adjustment members each include gears.

52. The bow sight of claim 49, wherein the first, second and third adjustment members directly engage the first, second and third pins, respectively.

53. The bow sight of claim 49, wherein the first pin is shorter than the second pin, and the second pin is shorter than the third pin.

54. The bow sight of claim 49, wherein the first, second and third pins are metal.

55. A bow sight comprising:

a first pin and a second pin positioned behind the first pin; the second pin being longer than the first pin;

first and second fiber optic members that are respectively secured to the first and second pins, the first fiber optic member defining a first sight point at the first pin, and the second fiber optic member defining a second sight point at the second pin;

wherein the first and second pins are vertically aligned when viewed by the archer while holding the bow in a shooting position.

56. The bow sight of claim 55, wherein the first and second pins are metal.

57. The bow sight of claim 55, further comprising a third pin and a third fiber optic member secured to the third pin, the third fiber optic member defining a third sight point, the third pin being positioned behind the second pin and being longer than the second pin, the first, second and third pins being vertically aligned when viewed by the archer while holding the bow in the shooting position.

58. The bow sight of claim 55, wherein the first and second sight points are set to different elevations corresponding to different target distances.

59. The bow sight of claim 55, wherein at least one of the first and second sight pins is vertically adjustable.

60. The bow sight of claim 59, wherein both the first and second sight pins are vertically adjustable.

61. The bow sight of claim 57, wherein all of the first, second and third sight pins are vertically adjustable.

* * * * *